US005195258A

United States Patent [19]

Loader

[11] Patent Number: 5,195,258

[45] Date of Patent: Mar. 23, 1993

[54] HIGH-HEELED FOOTWEAR

[76] Inventor: Gerald R. Loader, 49 Gatewick Close, Lansdowne Avenue, Slough, Berkshire, United Kingdom, SL1 3SE

[21] Appl. No.: 744,463

[22] Filed: Aug. 12, 1991

Related U.S. Application Data

[63] Continuation-in-part of Ser. No. 501,596, Mar. 29, 1990, abandoned.

[30] Foreign Application Priority Data

Mar. 31, 1989 [GB] United Kingdom ..... 8907370

[51] Int. Cl.[5] ..... A43B 21/30

[52] U.S. Cl. ..... 36/38; 36/34 R; 36/7.8

[58] Field of Search ..... 36/7.8, 27, 34 R, 38, 36/105, 37

[56] References Cited

U.S. PATENT DOCUMENTS

| | | | |
|---|---|---|---|
| 1,587,749 | 6/1926 | Bierly | 36/7.8 X |
| 2,187,756 | 1/1940 | Schwellenbach | 36/34 |
| 2,424,609 | 7/1947 | Friedman, Jr. | 36/34 R X |
| 2,767,487 | 10/1956 | Friedman, Jr. | 36/34 A X |
| 3,044,191 | 7/1962 | Cayo | 36/34 |
| 4,566,206 | 1/1986 | Weber | 36/7.8 |
| 4,592,153 | 6/1986 | Jacinto | 36/38 |

FOREIGN PATENT DOCUMENTS

| | | | |
|---|---|---|---|
| 212187 | 11/1960 | Austria . | |
| 1249902 | 11/1960 | France | 36/34 R |
| 2105684 | 4/1972 | France . | |
| 457657 | of 1950 | Italy . | |
| 599554 | 11/1959 | Italy . | |
| WO88/05272 | 7/1988 | PCT Int'l Appl. . | |
| 569169 | 5/1945 | United Kingdom . | |
| 591740 | 8/1947 | United Kingdom . | |
| 660774 | 11/1951 | United Kingdom . | |
| 875788 | 8/1961 | United Kingdom . | |

OTHER PUBLICATIONS

*Washington Daily News*, Apr. 21, 1936, p. 20.

*Primary Examiner*—Paul T. Sewell
*Assistant Examiner*—BethAnne C. Cicconi
*Attorney, Agent, or Firm*—Perman & Green

[57] ABSTRACT

A high-heeled shoe has a resilient U-shaped blade which forms the heel of the shoe, one limb of the blade being fixed to a rear portion of the sole of the shoe, and the other limb of the blade resting on the ground. Between said one and said other limbs, the blade is gently curved.

9 Claims, 3 Drawing Sheets

HIGH-HEELED FOOTWEAR

This is a continuation-in-part of copending application Ser. No. 07/501,596 filed on Mar. 29, 1990, now abandoned.

FIELD OF THE INVENTION

This invention relates to footwear, and in particular to shoes and boots traditionally intended for wear by women and known as "high-heeled" shoes or boots.

BACKGROUND TO THE INVENTION

Such footwear is common, and is worn for the reasons that the footwear in itself is considered elegant, it accentuates the shape of the wearer's leg, and it increases the height of the wearer. However, traditional "high-heels" have the drawbacks that they can be uncomfortable and tiring, especially when worn for prolonged periods. This is attributable to three main reasons. Firstly, the human foot naturally projects forwardly from the leg generally at right angles. However, when walking or standing in high-heels the foot is forced to assume an unnatural downward angle of anything up to about 45 degrees, and thus the muscles controlling the ankle joint cannot work in their most effective and efficient manner. Secondly, due to the enforced angle of the foot, the load of the body cannot be borne primarily by the heel of the foot, with the toes and the ball of the foot being used primarily for balance and control, but, instead, the foot is forced into the shoe or boot, causing undue pressure on the ball of the foot and pinching of the wearer's toes and forward edges of the foot by the shoe or boot. Thirdly, walking involves, with each step, a three-fold action of placing the heel on the ground; "rolling" from the heel to the ball of the foot; and then lifting the ball of the foot from the ground. With conventional high-heels, as the heel is placed on the ground, the heel piece of the shoe or boot projects downwardly and forwardly and tends to dig into the walking surface, and then, with the rolling action of the step, the heel piece becomes more vertical and tends to lift the wearer's heel slightly. Thus, with each step, not only is there an abrupt physical shock caused by the heel piece digging into the walking surface, but also there is a kick-back effect at the beginning of the rolling action. It should also be noted that traditional high-heels, in addition to causing discomfort in the wearer's foot, also tend to produce back-ache, due to the unnatural walking action which is required.

With the foot geometry required by high-heels, some of the disadvantages mentioned above cannot be avoided, but the present invention is concerned with alleviating at least some of the disadvantages, whilst at the same time retaining the desirable or attractive features of high-heeled footwear.

The basic approach taken by the invention is to provide the degree of springiness to the heel. Such an approach has been taken in the past with regard to shoes in general, and in this connection reference is directed to patent specifications GB 569169, GB 660774, U.S. Pat. No. 1,625,048, U.S. Pat. No. 3,822,490, U.S. Pat. No. 4,592,153 and U.S. Pat. No. 2,447,603. More particularly, the provision of a degree of resilience to the heels of high-heeled footwear has been considered in the past, as shown in patent specifications FR 2112848, FR 2105684, GB 591740. GB 875788 and U.S. Pat. No. 3,044,191. A problem with the high-heels shown in these latter specifications is that none of them provides a shoe which combines the three features of elegance, stability and durability.

SUMMARY OF THE INVENTION

In accordance with the present invention, there is provided an article of high-heeled footwear which has a generally U-shaped support blade for the heel. The blade has an upper limb which is rigidly secured to the raised rear portion of the sole and extends forwardly from near the back of the sole along a major part of the length of the raised portion of the sole. This enables very firm fixing of the blade to the sole to provide good stability. The blade extends downwardly and forwardly from the upper limb in a gentle curve, and then extends rearwardly as a generally flat lower limb which contacts the ground directly or has a thin pad secured thereto. The lower limb of the blade extends sufficiently far rearwardly so that it terminates behind the axis of the wearer's leg when standing upright, thus, providing good stability. The blade has a degree of resilience such that the lower limb slightly deflects vertically during walking, thus reducing the shocks transmitted to the leg and foot when walking. During walking, bending of the blade arises mainly in the gently curved portion. Because of the gentle curve, there is little risk of fatigue failure in the blade.

By comparison with the articles of high-heeled footwear in the prior art which can be considered to have any degree of elegance, the article shown in FR 2112848 has only a small area over which the heel blade is secured to the sole, and therefore suffers from the problems of lack of stability and likelihood of the blade being torn from the sole. The arrangement shown in GB 875788 employs a very tight bend between the portion of the blade which engages the ground and the portion of the blade which is secured to the sole of the shoe, that is to say, the blade is V-shaped. Accordingly, there will be substantial stress concentration at the bend in the blade, and thus fatigue failure is likely in the arrangement of GB 875788. The arrangement shown in U.S. Pat. No. 3,044,191 is somewhat similar to that of FR 2112848, but additionally the blade is shaped transversely so that bending arises only in a small portion of the blade, and therefore this arrangement will also be prone to fatigue failure in the bending zone.

Preferably, the support blade of the invention provides the only means of support for the rear of the shoe.

DESCRIPTION OF THE PREFERRED EMBODIMENT

Figure 1:
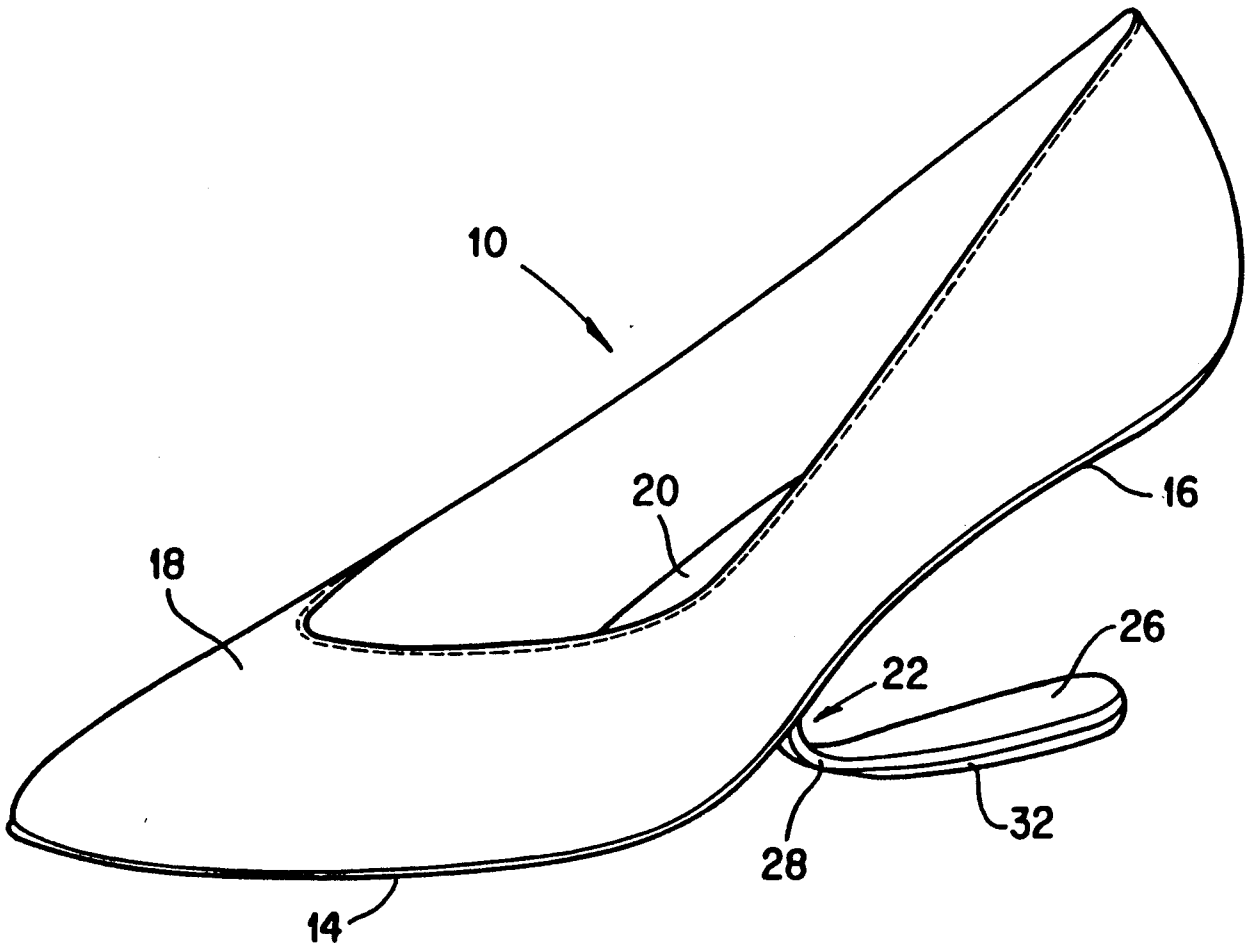
FIG. 1 is a perspective view of a high-heeled shoe.

Referring to the drawings, a high-heeled shoe 10 has an outer sole 12 comprising a generally flat fore portion 14 and a rear portion 16 which extends upwardly and rearwardly from the fore portion 14 at an angle generally of about 30 degrees. An upper 18 is secured to the outer sole 12, and an inner sole 20 is secured within the shoe with suitable cushioning material. As described so far, the shoe 10 is conventional, and conventional shoemaking techniques are employed in forming and securing together the various components.

The shoe further comprises a U-shaped support blade 22 having an upper limb 24, a generally flat lower limb 26, and between those two portions a gently curving portion 28. The angle between the upper and lower limbs 24, 26 is about equal to the general angle of the rear portion 16 of the sole to the horizontal, and the upper limb 24 may be bent slightly so as to conform to the shape of the rear portion 16 of the sole.

Figure 2:
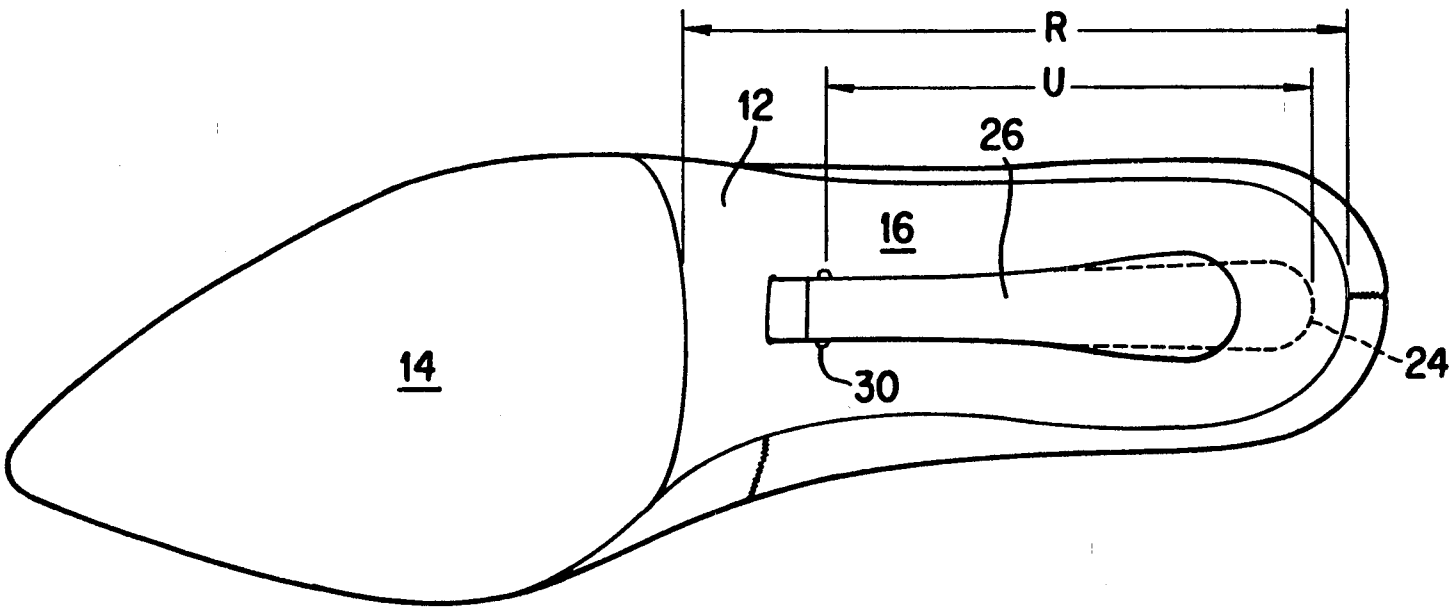
FIG. 2 is an under plan view of the shoe.
Figure 3:
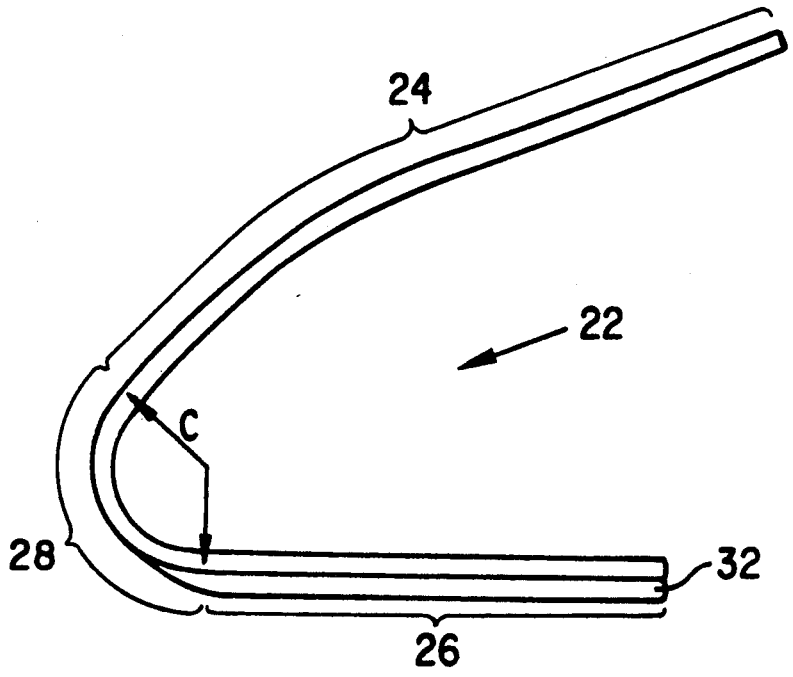
FIG. 3 is a side view of the support blade.

The upper limb 24 of the support blade is secured to the rear sole portion 16 in one of two ways. It can simply be attached beneath the rear sole portion 16, or more preferably, and as shown in the drawings, it can be sandwiched between the rear sole portion 16 and the inner sole 20, with a slit 30, the ends of which can be seen in FIG. 2, being formed in the rear sole portion 16 through the blade 22 passes as it transforms between the upper limb 24 and the gently curving portion 28. The blade 22 is fixed in place by adhesive and/or fastening elements such as screws which engage tapped holes in the blade 22, or screws and nuts, or more preferably rivets. The upper limb 24 of the support blade 22 should be secured to the sole as rigidly as possible so as to provide proper stability for the shoe, so as to reinforce the rear sole portion 16, and (in the case where the upper limb 26 is sandwiched between the outer and inner soles) so as to prevent movement of the upper limb of the blade within the shoe, which would otherwise cause discomfort or annoyance to the wearer. As shown in FIGS. 1 and 3, a durable heel piece of substantially the same shape as the lower limb 26 of the support blade is attached thereto, for example by way of adhesive. As shown by dotted lines in FIG. 2, the upper limb 24 of the blade extends rearwardly almost as far as the rear edge of the rear portion 16 of the sole. Furthermore, the upper limb 24 of the support blade extends over a length U which is more than fifty percent of the total length R of the rear portion 16 of the sole. More preferably, the dimension U is at least seventy percent of the dimension R, and, as shown in the drawing, may be for example about seventy five percent.

In a typical example of the shoe, the average radius of curvature C of the curved portion 28 of the support blade 22 is about 12 mm. The curvature can be tighter than this, for example a radius of 8 mm, or possibly even 6 mm, but the radius of curvature should not be smaller than this, otherwise the stress concentration in the curved portion 28 of the support blade 22 will be high, and may lead to failure. The radius of curvature may be greater than 12 mm for example 16 mm or even 20 mm, but should not be much greater than this, otherwise the length of the upper limb 24 which is secured to the sole of the shoe, will necessarily be decreased, thus resulting in reduced stability.

The length L of the lower limb 26 of the support blades 22 should be sufficiently long so that the shoe feels stable to the wearer, but should not be unnecessarily long, otherwise the aesthetic appeal of the shoe is reduced. Typically, the length L is about 55 mm, but it may be acceptable for the length L to be within ten or even twenty percent of this value depending upon the particular geometry and size of the shoe.

The support blade 22 may be formed from any suitable material, and it has been found that high-tensile steel meets the necessary requirements. In this case, the width of the support blade may be as small as about 15 mm, but is preferably about 20 mm. The lower limb 26 thereof may be widened slightly, as shown in FIG. 2. Furthermore, the thickness of the support blade 22 may be as small as about 2.5 mm, but is preferably about 3.25 mm. It will be appreciated that, even using the same material other dimensions of the support blade will produce the desired results, for example by widening the blade, but making it thinner. It is also envisaged that stainless steel will be a suitable material for the support blade.

In one particular prototype of the shoe, carbon steel grade "CS-70" was used for the support blade 22 having a thickness of 3.25 mm and a width of 20 mm. The steel was hardened to 48° to 49° Rockwell C and, at the curved portion 28, the blade was finished to remove any antielastic curvature. The blade was shot-peened for 20 minutes in a tumble blast type machine, using shot number S 330. In tests, with a wearer weighing 147 lbs standing back on the heel of the shoe and using her other foot for steadying herself without applying any significant weight on it, the vertical deflection of the free end of the lower limb 26 of the heel was found to be 9 mm, that is about 60 micrometers deflection per pound bodyweight. This prototype was found to produce satisfactory results as regards comfort and stability. It is envisaged that some people may prefer a stiffer heel producing a vertical deflection of say 45 or 30 micrometers per pound bodyweight when substantially all of the bodyweight is applied to the heel. Others may prefer a more flexible heel producing a vertical deflection of say 75 micrometers per pound bodyweight when substantially all of the bodyweight is applied to the heel. It will be appreciated that the required stiffness of the heel may be provided by appropriately selecting the thickness and width of the blade 22 at the curved portion 28.

As regards durability, two prototypes have each been tested by repeatedly applying a vertical load of 160 lbs to the shoe, and the heels survived 500,000 cycles each of such loading without failure and with permanent vertical deformations of the free ends of the lower limbs 26 of merely about 0.23 mm.

The dimensions of the support blade given above are applicable in respect of a shoe of size 5 (UK), 6.5 (US), or 38 (continental), and may need to be scaled to some extent for other sizes of shoe.

what I claim is:

1. An article of high-heeled footwear having a sole with a fore portion positionable beneath the ball and toes of a wearer's foot and a rear portion having a length extending rearwardly and upwardly from the fore portion and positionable beneath the arch and heel of the wearer's foot, and a generally U-shaped support blade of substantially rectilinear cross-section having an upper limb rigidly secured to the rear portion of the sole and extending forwardly from an end of the blade at a position adjacent a back of the rear portion of the sole along more than 50% of the length of the rear portion of the sole, the blade then extending downwardly and rearwardly and away from the sole as a gently curved portion having a radius of curvature of at least 8 mm and no more than 20 mm, and the blade then extending rearwardly and away from the sole to a free end of the blade as a generally flat lower limb lying generally in a plane between the plane of the fore portion of the sole and a plane slightly thereabove, the lower limb having a length of between 44 mm and 66 mm, the blade having a degree of resilience such that the free end of the lower limb deflects vertically towards the back of the rear portion of the sole by a deflection of at least 30 micrometers per pound of bodyweight of a wearer when substantially all of the bodyweight of the wearer is statically applied to the heel, and the lower limb of the blade being connected to the sole only by means of the sole being secured to the upper limb and the upper limb being connected to the lower limb through the curved portion of the blade.

2. An article as claimed in claim 1, wherein said deflection per pound bodyweight is at least 45 micrometers.

3. An article as claim in claim 1 wherein said deflection per pound bodyweight is not greater than 75 micrometers.

4. An article as claimed in claim 1, wherein said deflection per pound bodyweight is about 60 micrometers.

5. An article as claimed in claim 1, wherein the curved portion of the blade has a radius of curvature of no more than 16 mm.

6. An article as claimed in claim 1, wherein the radius of curvature of the curved portion is about 12 mm.

7. An article as claimed in claim 1, wherein the upper limb of the support blade extends over more than seventy percent of length of the rear portion of the sole.

8. An article as claimed in claim 1, wherein the upper limb of the support blade extends over about seventy five percent of the length of the rear portion of the sole.

9. An article as claimed in claim 1, wherein the length of the lower limb of the support blade is about 55 mm.

* * * * *